US006881936B2

(12) United States Patent
Shon et al.

(10) Patent No.: US 6,881,936 B2
(45) **Date of Patent: *Apr. 19, 2005**

(54) APPARATUS AND METHOD FOR AUTOMATICALLY COOKING FRUIT

(75) Inventors: Jong-Chull Shon, Suwon (KR); Boris V. Rayskiy, Suwon (KR); Tai Eun Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/397,222

(22) Filed: Mar. 27, 2003

(65) Prior Publication Data

US 2004/0104223 A1 Jun. 3, 2004

(30) Foreign Application Priority Data

Dec. 2, 2002 (KR) ..... 10-2002-0075785

(51) Int. Cl.[7] ..... H05B 6/50

(52) U.S. Cl. ..... 219/707; 219/400; 219/731

(58) Field of Search ..... 219/494, 510, 219/678, 681, 682, 686, 687, 688, 702, 707, 710, 725, 731; 99/339, 443; 426/510

(56) References Cited

U.S. PATENT DOCUMENTS 4,233,327 A * 11/1980 Ando et al. ..... 426/242
4,401,884 A * 8/1983 Kusunoki et al. ..... 219/492
4,499,357 A * 2/1985 Kojima ..... 219/711
4,571,341 A * 2/1986 Sugimura ..... 426/510
4,880,648 A 11/1989 Stamer
5,567,458 A * 10/1996 Wu ..... 426/233
5,589,094 A * 12/1996 Bu ..... 219/711

OTHER PUBLICATIONS

U.S. Appl. No. 10/397,248, filed Mar. 27, 2003, Jong–Chull Shon et al., assignee Samsung Electronics Co., Ltd.

U.S. Appl. No. 10/397,386, filed Mar. 27, 2003, Jong–Chull Shon et al., assignee Samsung Electronics Co., Ltd.

* cited by examiner

*Primary Examiner*—Tu Hoang
(74) *Attorney, Agent, or Firm*—Staas & Halsey LLP

(57) ABSTRACT

An apparatus and a method implement automatic cooking, which may automatically cook compote, thus conveniently providing the uniform and optimal cooking quality of compote to a user. The cooking apparatus includes a cooking cavity that contains food to be cooked and water therein, and a heating unit that heats the food and the water. The cooking apparatus further includes a control unit operated to heat the food and the water at a preset initial output of the heating unit, to reduce the output of the heating unit to a first reduced output, allow a heated high temperature water to be absorbed into the food after the water is boiled, and to increase and reduce the output of the heating unit in stages to reduce an amount of the water.

36 Claims, 6 Drawing Sheets

FIG. 3

| BLOWING TIME | BOILING | | | SIMMERING | | FIRST STEAMING STAGES | | | | SECOND STEAMING STAGE | |
|---|---|---|---|---|---|---|---|---|---|---|---|
| | OUTPUT ($P_f$) | COEFF-ICIENT ($\rho$) | MAXIMUM $T_f$ | OUTPUT ($P_1$) | TIME ($T_1$) | OUTPUT ($P_2$) | TIME ($T_2$) | OUTPUT ($P_3$) | TIME ($T_3$) | OUTPUT ($P_e$) | END TIME ($T_e$) |
| 0:50 | 900W | 0.60 | 9:00 | 500W | 2:00 | 600W | 2:00 | 700W | 1:00 | 500W | 17:00 |

APPARATUS AND METHOD FOR AUTOMATICALLY COOKING FRUIT

CROSS-REFERENCE TO RELATED APPLICATIONS

This application claims the benefit of Korean Application No. 2002-75785, filed Dec. 2, 2002, in the Korean Intellectual Property Office, the disclosure of which is incorporated herein by reference.

BACKGROUND OF THE INVENTION

1. Field of the Invention

The present invention relates, in general, to an apparatus and a method for automatic cooking, and, more particularly, to an apparatus and a method for automatic cooking, which cooks food using an automatic cooking algorithm.

2. Description of the Related Art

Compote is a dish of fruit stewed or cooked in a syrup prepared by putting dried fruits into water and stewing them. A basic method of cooking compote is to put dried fruits and a proper amount of water and sugar in a vessel, and cook by heating the vessel. If water is stewed for a long time after the dried fruits and sugar are put in the water, a flesh of the dried fruits absorbs the water, and compote is therefore cooked to have a desirably edible condition, and taste becomes better by adding refined sugar and sugar extracted from the dried fruits. However, if the water is heated at an extremely high temperature for a long time when the compote is cooked, the optimal cooking quality of the compote may not be obtained. Accordingly, the cooking of the compote should be carried out while the heating power is reduced in stages to obtain the satisfactory cooking quality of the compote. Additionally, a cooking result depends on respective durations of the cooking stages.

When compote is cooked, a gas/electric equipment, such as a cooking top, is generally used to heat a vessel. Notwithstanding that the cooking quality of the compote depends on the precise control of applied heating power and a cooking time for which the compote is cooked, the cooking of the compote is carried out depending on the judgment of a cook, so it is difficult to obtain the optimal and uniform cooking quality of the compote. Additionally, a cook should control heating power and ascertain the cooking state of the compote while standing by beside the cooking equipment, so the cook may not do other things until cooking is terminated. That is, the cook may not effectively manage the cooking time of the compote.

SUMMARY OF THE INVENTION

Accordingly, it is an aspect of the present invention to provide an apparatus and a method for automatic cooking, which is capable of automatically cooking compote, thus conveniently providing the uniform and optimal cooking quality of a compote to a user.

Additional aspects and advantages of the invention will be set forth in part in the description which follows and, in part, will be obvious from the description, or may be learned by practice of the invention.

The foregoing and/or other aspects of the present invention are achieved by providing an apparatus for automatic cooking including a cooking cavity that contains food to be cooked and water therein, a heating unit that heats the food and the water, and a control unit operated to heat the food and the water at a preset initial output of the heating unit, first to reduce the output of the heating unit to a first reduced output and allow the heated high temperature water to be absorbed into the food after the water is boiled, and second, to increase and reduce the output of the heating unit in stages to reduce an amount of the water.

Additionally, the foregoing and/or other aspects of the present invention are achieved by providing an apparatus for automatic cooking including a cooking cavity that contains food to be cooked and water therein, a heating unit that heats the food and the water, a gas sensor that detects properties of air inside the cooking cavity, and a control unit to obtain an output of the gas sensor while the food and the water are heated at a preset initial output of the heating unit, to reduce the output of the heating unit to a first reduced output and allow the heated high temperature water to be absorbed into the food if the output of the gas sensor reaches a preset value, and then to increase and reduce the output of the heating unit in stages to reduce an amount of the water.

The foregoing and/or other aspects of the present invention are achieved by providing a method for automatic cooking using a cooking apparatus, the cooking apparatus having a cooking cavity that contains food to be cooked and water therein and a heating unit that heats the food and the water, the method including heating the food and the water at a preset initial output of the heating unit, reducing the output of the heating unit to a first reduced output and allowing the heated high temperature water to be absorbed into the food after the water is boiled, and then, increasing and reducing the output of the heating unit in stages to reduce an amount of the water.

Additionally, the foregoing and/or other aspects of the present invention are achieved by providing a method for automatic cooking using a cooking apparatus, the cooking apparatus having a cooking cavity that contains food to be cooked and water therein, a heating unit that heats the food and the water, and a gas sensor that detects properties of air inside the cooking cavity, the method including obtaining an output of the gas sensor while the food and the water are heated at a preset initial output of the heating unit, reducing the output of the heating unit to a first reduced output and allowing the heated high temperature water to be absorbed into the food if the output of the gas sensor reaches a preset value, and then, increasing and reducing the output of the heating unit in stages to reduce an amount of the water.

BRIEF DESCRIPTION OF THE DRAWINGS

These and other aspects and advantages of the invention will become apparent and more readily appreciated from the following description of the preferred embodiment, taken in conjunction with the accompanying drawings of which:

FIG. 3 is a table illustrating the characteristics of a cooking operation for cooking compote using the microwave oven shown in FIG. 1;

DETAILED DESCRIPTION OF THE PREFERRED EMBODIMENTS

Figure 1:
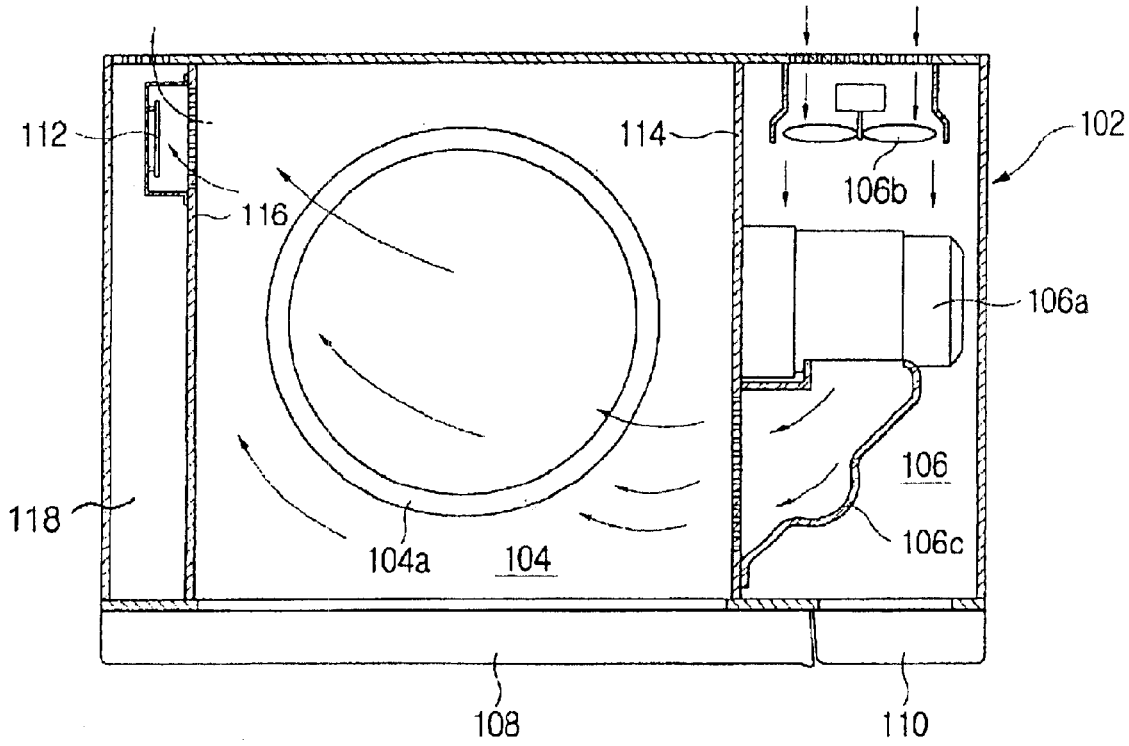
FIG. 1 is a sectional view of a microwave oven in accordance with an embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

An apparatus and a method implement automatic cooking in accordance with an embodiment of the present invention, with reference to the accompanying drawings FIGS. 1 to 5. FIG. 1 is a sectional view of a microwave oven in accordance with an embodiment of the present invention. As shown in FIG. 1, a body 102 of the microwave oven is divided into a cooking cavity 104 and a machine room 106 separated from each other by a partition wall 114. A control panel 110 and a door 108 are positioned in front of the body 102.

A cooking tray 104*a* is disposed to be rotatable in the lower part of the cooking cavity 104, and food to be cooked is put on the cooking tray 104*a*. A space 118 separated from the cooking cavity 104 by a partition wall 116 is positioned to be opposite to the machine room 106. In this space, a gas sensor 112 is disposed to detect specific properties of air inside the cooking cavity 104. In an embodiment of the present invention, the gas sensor 112 is used to detect an amount of moisture contained in the air inside the cooking cavity 104 and output a voltage signal S that is inversely proportional to the amount of the moisture contained in the air.

The machine room 106 includes a magnetron 106*a*, a cooling fan 106*b* and an air duct 106*c*. The magnetron 106*a* generates microwaves. The cooling fan 106*b* cools the magnetron 106*a* by sucking external air. The air sucked through the cooling fan 106*b* is supplied to the cooking cavity 104 through the air duct 106*c* of the machine room 106. The air passed through the cooking cavity 104 is discharged from the body 102 while passing the gas sensor 112.

Figure 2:
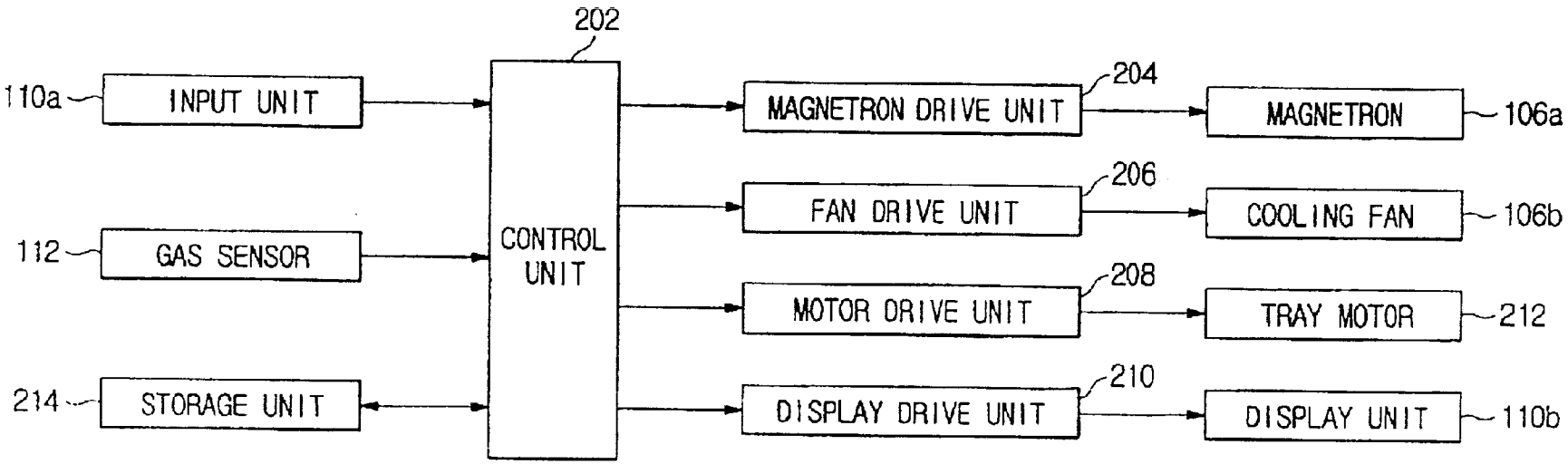
FIG. 2 is a control block diagram of the microwave oven shown in FIG. 1.

FIG. 2 is a control block diagram of the microwave oven shown in FIG. 1. As shown in FIG. 2, a control unit 202 is connected at input terminals to an input unit 110*a*, the gas sensor 112, and a storage unit 214. The input unit 110*a* is positioned in the control panel 110 shown in FIG. 1. A user selects or inputs cooking conditions, sets values, etc., through the input unit 110*a*. The storage unit 214 stores programs, cooking data, etc., that are required to control the overall operation of the microwave oven. For example, the cooking data include data on the respective outputs of the magnetron 106*a* and respective cooking times of cooking stages that are required to cook compote. The control unit 202 allows the compote to be cooked automatically by determining the outputs of the magnetron 106*a*, and the cooking times with reference to the cooking data stored in the storage unit 214.

The control unit 202 is connected at output terminals to a magnetron drive unit 204, a fan drive unit 206, a motor drive unit 208 and a display drive unit 210 that drives the magnetron 106*a*, the cooling fan 106*b*, a tray motor 212 and a display unit 110*b*, respectively. The tray motor 212 rotates a tray 104*a* disposed in the cooking cavity 104. The display unit 110*b* is positioned on the control panel 110 shown in FIG. 1, and displays cooking conditions, set values, cooking progressing state, etc., that are inputted from a user.

To implement the apparatus and method for automatic cooking of the present invention, it is desirable to obtain the cooking data of the compote required to obtain an optimal and uniform cooking quality of the compote by ascertaining the properties of the compote and executing cooking tests under various conditions. If water is heated at a high temperature for a short time, the insides of dried fruits are not sufficiently cooked and the surfaces of the dried fruits may be damaged. Accordingly, water should be heated enough to be boiled at the start of the cooking of the compote. Thereafter, when the water is boiled, the dried fruits should be cooked for a sufficient time so that the heated water is absorbed into the dried fruits while heating power is reduced. To obtain the optimal quality of the compote, appropriate heating power and cooking time, as described below, should be controlled in each of the cooking stages.

The cooking stages of the compote are divided into a boiling stage, a simmering stage, a first steaming stage, and a second steaming stage for thoroughly cooking compote. Appropriate heating power and cooking time are set in each of the cooking stages. To cook the compote, the boiling stage is first carried out, wherein water is boiled by heating a vessel that contains the water, the dried fruits and sugar. After the water is boiled, the simmering stage is carried out, wherein the heating power is reduced so that the temperature of the reduced heating power is appropriately maintained, and high temperature water is sufficiently absorbed into the insides of the dried fruits. When the simmering stage is completed, the first steaming stage is carried out, wherein the heating power is increased in stages and the amount of the water is thus reduced. Thereafter, the second steaming stage is carried out, wherein cooking is performed for a long time at the same output as the output of the simmering stage, and the taste and consistency of the compote are therefore optimized. That is, the water is sufficiently absorbed into the dried fruits in the simmering stage, and the amount of the water is gradually reduced, and the taste and consistency of the compote are therefore improved in the first and second steaming stages.

Cooking characteristics of the compote described above are shown in FIGS. 3 and 4. FIG. 3 is a table of the cooking characteristics of the compote in accordance with an embodiment of the present invention, which illustrates the outputs of the magnetron 106*a* and cooking times needed in the cooking stages. To carry out automatic cooking of the compote according to an embodiment of the present invention, an initial stage in which an initial output $S_0$ of the gas sensor 112 is calculated is performed before the magnetron 106*a* is operated. That is, the cooking time of the boiling stage depends on the amount of moisture generated in the boiling stage in the automatic cooking of the compote. An ending time point of the boiling stage is determined on the basis of the ratio of the current output S of the gas sensor 112 to the initial output $S_0$ of the gas sensor 112. In the initial stage to obtain the initial output $S_o$ of the gas sensor 112, moisture inside the cooking cavity 104 is minimized by blowing external air into the cooking cavity 104 for a predetermined time, for example, 50 seconds, and circulating the air using the cooling fan 106*b* of the machine room 106. When the blowing of the air is completed, the initial output So of the gas sensor 112 is obtained.

In the boiling stage, the output $P_f$ of the magnetron 106*a* is 900 W. The cooking time of the boiling stage ranges from an initial time point to a time point at which the ratio of the current output S of the gas sensor 112 to the initial output $S_0$ of the gas sensor 112 is greater than a preset coefficient ρ, that is, $S/S_0>\rho$. The coefficient ρ is 0.6 when the automatic cooking of the compote is carried out. That is, if the current output S of the gas sensor 112 is equal to or less than 60% of the initial output $S_0$ of the gas sensor 112, the boiling stage is terminated. Further, if the current output S of the gas sensor 112 is reduced to be equal to or less than a preset value $\phi$, the boiling stage may be set to be terminated. The preset value $\phi$ may be changed according to the characteristics and type of the gas sensor 112, and is set to a value by which the cooking time of the boiling stage may be limited to an optimal time obtained by cooking tests regardless of a kind of the gas sensor being used. However, in the case where equipment malfunctions, such as the wrong operation of the gas sensor 112, occurs, the cooking time $T_f$ of the boiling stage is limited to a maximum of 9 minutes according to the quantity of the compote to prevent the cooking time of the boiling stage from overextending. If the boiling stage is completed, the output of the magnetron 106*a* is reduced to 50~70% of the output of the boiling stage, and cooking is carried out for 2 minutes regardless of the quantity of the compote.

In the first steaming stage, cooking is carried out while the output of the magnetron 106*a* is increased by 100 W in two steps. That is, cooking is carried out at the output of 600 W for two minutes in the first step of the first steaming stage, and cooking is carried out at the output of 700 W for one minute in the second step of the first steaming stage. In the first steaming stage, the consistency of the compote is adjusted by continuously steaming the dried fruits and evaporating the water. In the second steaming stage, the taste and consistency of the compote is optimized. The second steaming stage is continued until a total cooking time reaches 17 minutes at an output of 500 W, the same output as that of the simmering stage. As shown in FIG. 3, the total cooking time is set to 17 minutes. Accordingly, it will be appreciated that the second steaming stage of the automatic cooking of the compote is carried out for the remaining time obtained by subtracting the cooking time of the boiling, simmering and first steaming stages from the total cooking time. Alternatively, the cooking time of the second steaming stage may be set to a preset time when the simmering and the first steaming stages are each carried out for a preset cooking time.

Figure 4:
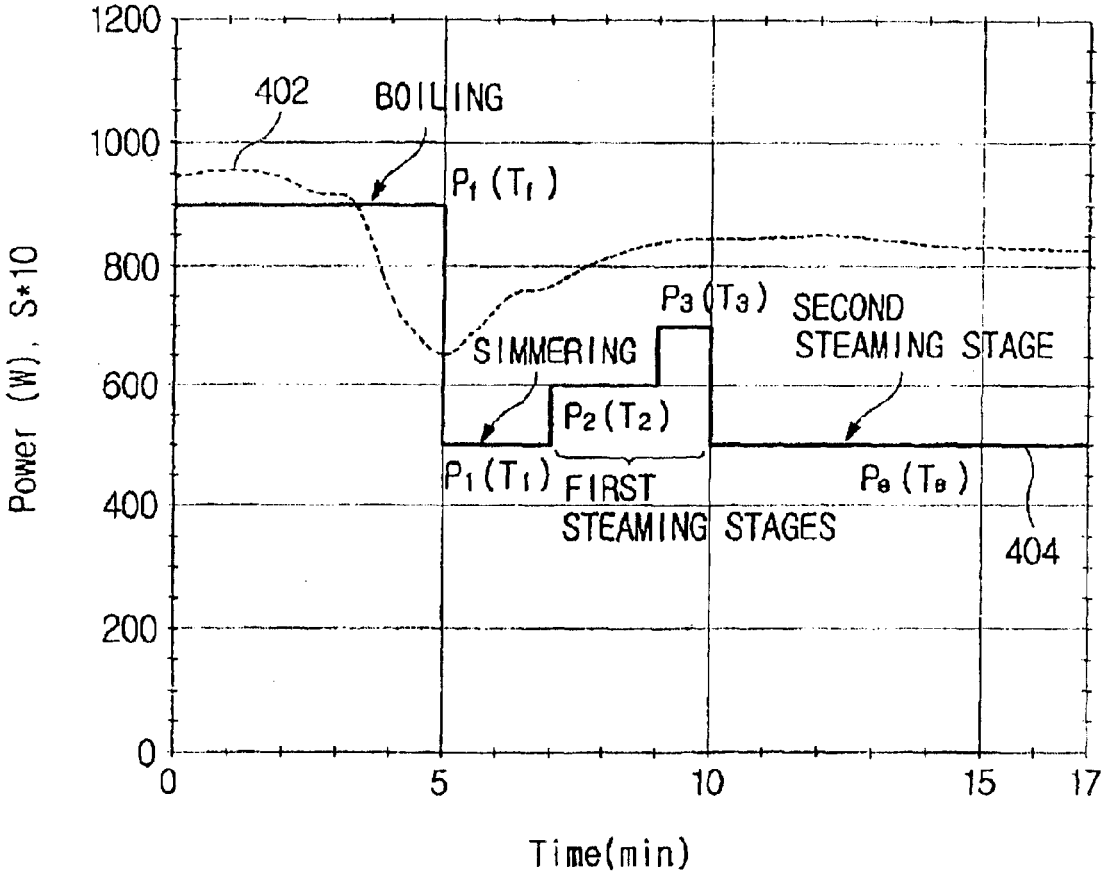
FIG. 4 is a graph illustrating an example of a cooking algorithm of cooking the compote in the microwave oven shown in FIG. 1.

FIG. 4 is a graph of a cooking algorithm of the compote of the microwave oven in accordance with the embodiment of the present invention. A characteristic curve 402 represents the output of the gas sensor 112, that is, the voltage of the gas sensor 112, and the characteristic curve 404 represents the output P of the magnetron 106*a* and the cooking time T of the compote. In FIG. 4, the boiling stage to cook the compote is carried out at the output of 900 W for about 5 minutes. At the time point 5 minutes after the start of cooking of the compote, that is, the starting point of the simmering stage, the current output S is reduced to 60% of the initial output $S_0$. After the boiling stage is completed, the simmering stage is directly carried out at the output of 500 W for 2 minutes. Subsequently, the first steaming stage is carried out at the outputs of 600 W and 700 W for 2 minutes and 1 minute, respectively. The second steaming stage is carried at the output of 500 W until the total cooking time reaches 17 minutes. That is, in the case of the compote cooking shown in FIG. 4, since the initial stage (not shown), the boiling stage, the simmering stage and the first steaming stages are each carried out for 50 seconds, 5 minutes, 2 minutes, and 3 minutes, respectively, and the second steaming stage is carried out for 6 minutes and 10 seconds, and therefore, the total cooking time is 17 minutes.

Figure 5A:
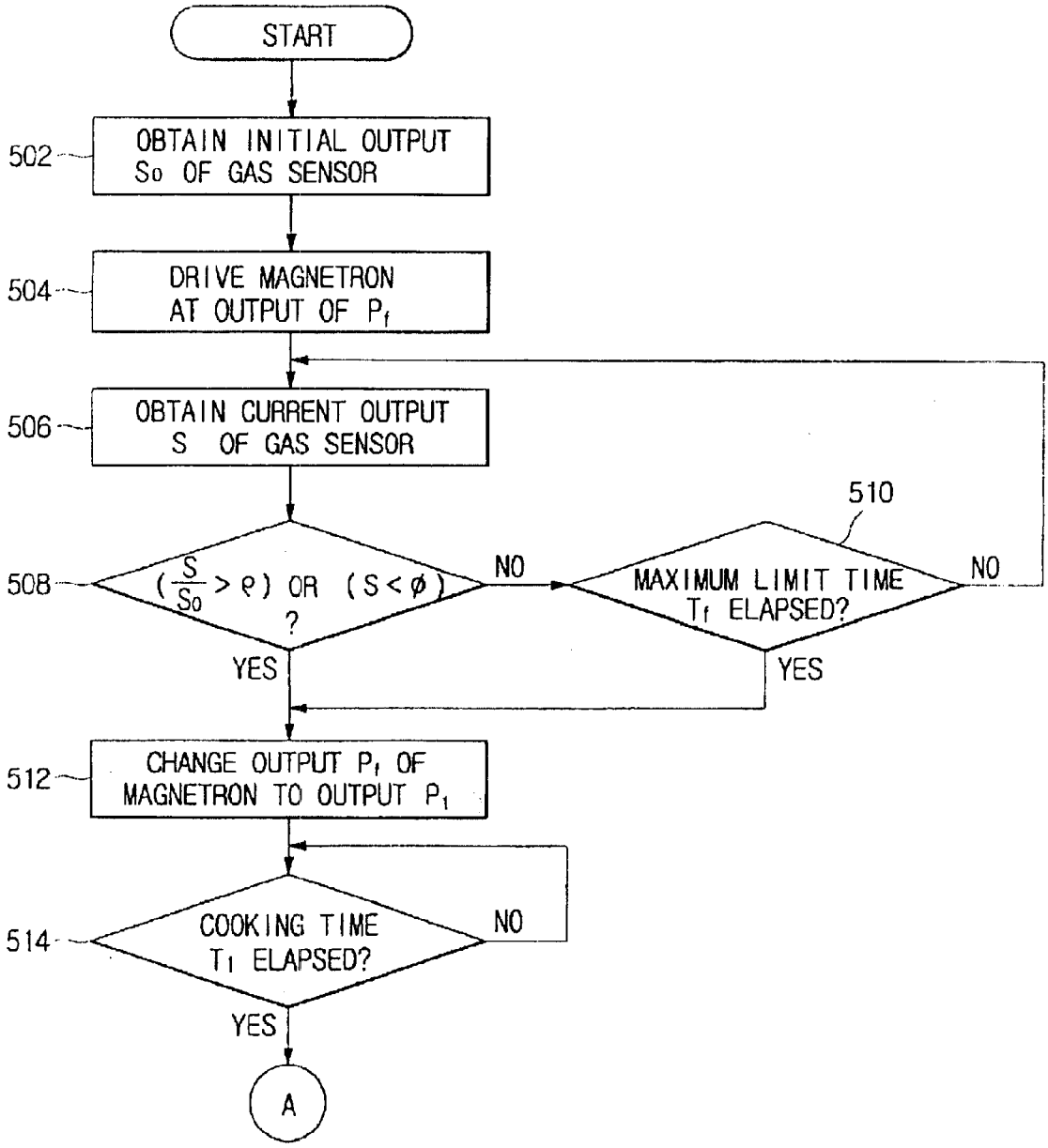
FIGS. 5A and 5B are flowcharts of a method of cooking compote using the microwave oven shown in FIG. 1.
Figure 5B:
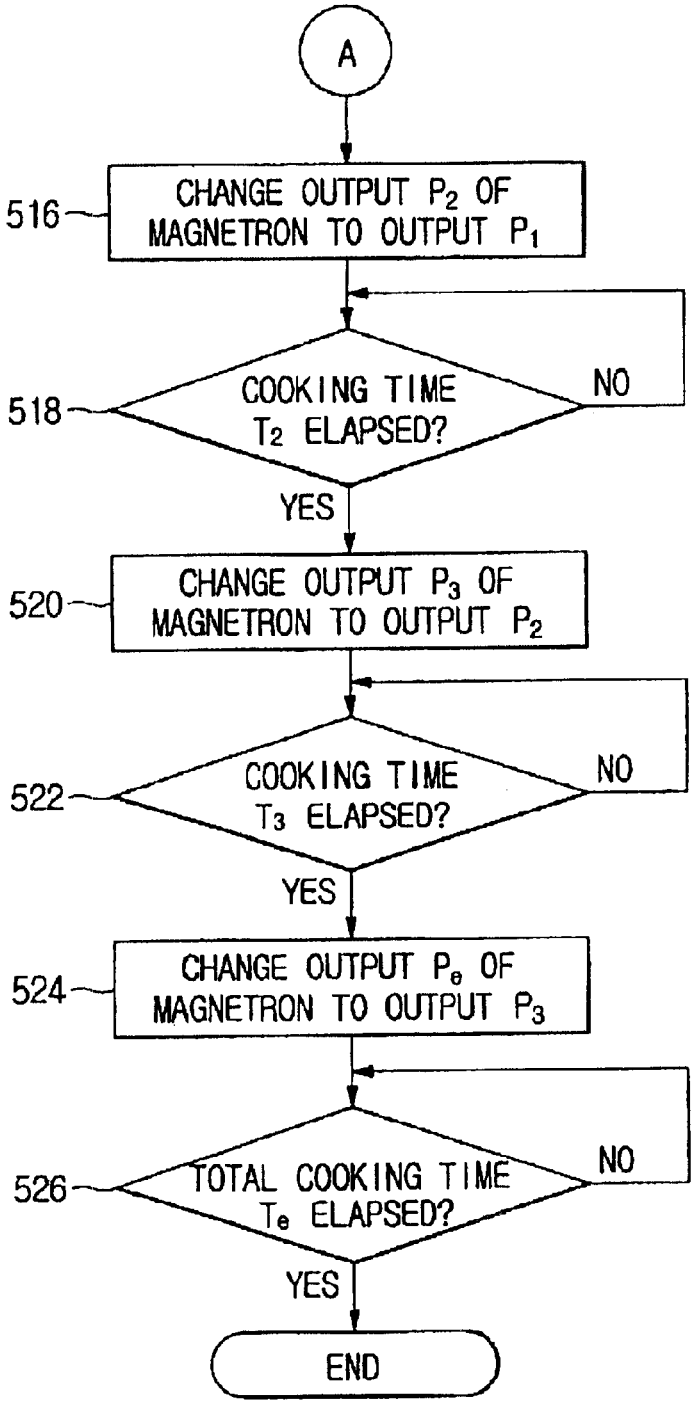

FIGS. 5A and 5B are flowcharts of a method of cooking compote using the microwave oven in accordance with an embodiment of the present invention. As shown in FIGS. 5A and 5B, after moisture inside the cooking cavity 104 is minimized by blowing air into the cooking cavity 104 of the microwave oven, the initial output So of the gas sensor 112 is obtained at operation 502. Thereafter, the boiling stage is carried out at the output $P_f$ of the magnetron 106*a* at operation 504. The current output S of the gas sensor 112 is obtained for the boiling stage at operation 506. It is determined whether $S/S_0$ is greater than $\rho$ or S is less than $\phi$, that is, $S/S_0>\rho$ or $S<\phi$ at operation 508. If $S/S_0>\phi$ or $S<\phi$, the simmering stage is carried out at an output $P_1$ after the output of the magnetron is changed to the output $P_1$ at operation 512. To the contrary, if $S/S_0 \leqq \rho$ or $S \geqq \phi$, it is determined whether the maximum limit time of the $T_f$ of the boiling stage has elapsed at operation 510. If the maximum limit time of the $T_f$ has not elapsed, the operation 506 of obtaining the current output S of the gas sensor 112 is repeated, while if the maximum limit time of the $T_f$ has elapsed, the simmering stage is carried out at the output $P_1$ after the output of the magnetron 106*a* is changed to the output $P_1$ at operation 512. Then, it is determined whether a preset cooking time $T_1$ of the simmering stage has elapsed at operation 514. If the preset cooking time $T_1$ of the simmering stage has elapsed, the first step of the first steaming stage is carried out at an output $P_2$ after the output of the magnetron 106*a* is changed to the output $P_2$ at operation 516. Thereafter, it is determined whether a preset cooking time $T_2$ of the first stage of the first steaming stage has elapsed at operation 518. If the preset cooking time $T_2$ of the first step of the first steaming stage has elapsed, the second step of the first steaming stage is carried out at an output $P_3$ after the output of the magnetron 106*a* is changed to the output $P_3$ at operation 520. Thereafter, it is determined whether a preset cooking time $T_3$ of the second step of the first steaming stage has elapsed at operation 522. If the preset cooking time $T_3$ has elapsed at operation 522, the second steaming stage is carried out at an output $P_e$ after the output of the magnetron 106*a* is changed to the output $P_e$ at operation 524. Then, it is determined whether a preset total cooking time $T_e$ has elapsed at operation 526. If the preset total cooking time $T_e$ has elapsed, the cooking of the compote is terminated. The output $P_3$ is greater than the output $P_2$, and the output $P_e$ is less than the output $P_3$ and the output $P_2$ in this instance.

As is apparent from the above description, the present invention provides an apparatus and a method for automatic cooking, which cook compote according to an automatic cooking algorithm, thus providing the uniform and optimal cooking quality of the compote in every cooking of compote.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An automatic cooking apparatus, comprising:

a cooking cavity that contains food to be cooked and water therein;

a heating unit that heats the food and the water; and a control unit operated to heat the food and the water at a preset initial output of the heating unit, to reduce the output of the heating unit to a first reduced output and allow the heated temperature water to be absorbed into the food after the water is boiled, and then, to increase and reduce the output of the heating unit in stages to reduce an amount of the water.

2. The apparatus as set forth in claim 1, wherein the food includes dried fruit.

3. The apparatus as set forth in claim 1, wherein the first reduced output of the heating unit is 50~70% of the initial output.

4. The apparatus as set forth in claim 1, wherein the heating unit is a high frequency generation unit, and a maximum output of the high frequency generation unit is defined as the initial output.

5. The apparatus as set forth in claim 1, wherein the heating unit is a high frequency generation unit, an initial output of the high frequency generation unit is 900 W, and the first reduced output of the high frequency generation unit is 450~630 W.

6. An automatic cooking apparatus, comprising:

a cooking cavity that contains food to be cooked and water therein;

a heating unit that heats the food and the water;

a gas sensor that detects properties of air inside the cooking cavity; and a control unit operated to obtain an output of the gas sensor while the food and the water are heated at a preset initial output of the heating unit, to reduce the output of the heating unit to a first reduced output and allow a heated temperature water to be absorbed into the food if the output of the gas sensor reaches a preset value, and then to increase and reduce the output of the heating unit in stages to reduce an amount of the water.

7. The apparatus as set forth in claim 6, wherein the control unit reduces the output of the heating unit to the first reduced output if a ratio of a current output of the gas senor to an initial output of the gas sensor reaches a preset value by obtaining the initial output of the gas sensor before the food and the water are heated and obtaining the current output of the gas sensor when the food and the water are heated.

8. The apparatus as set forth in claim 7, wherein the control unit reduces the output of the heating unit to the first reduced output if the current output of the gas sensor is equal to or less than 60% of the initial output of the gas sensor.

9. The apparatus as set forth in claim 6, wherein the food includes dried fruit.

10. The apparatus as set forth in claim 6, wherein moisture inside the cooking cavity is minimized by circulating the air inside the cooking cavity to obtain the initial output of the gas sensor.

11. The apparatus as set forth in claim 10, further comprising a blowing unit that circulates the air inside the cooking cavity, wherein the heating unit is cooled by the blowing unit when the heating unit is operated.

12. The apparatus as set forth in claim 6, wherein the output of the gas sensor is a voltage level that is inversely proportional to moisture inside the cooking cavity.

13. The apparatus as set forth in claim 6, wherein a total cooking time is previously set according to an amount of the food, and an end time point of an increase and reduction operation of the heating unit's output is limited to an end time point of the total cooking time.

14. A method for automatic cooking using a cooking apparatus, the cooking apparatus having a cooking cavity that contains food to be cooked and water therein, and a heating unit that heats the food and the water, comprising:

heating the food and the water at a preset initial output of the heating unit;

reducing the output of the heating unit to a first reduced output and allowing a heated high temperature water to be absorbed into the food by after the water is boiled; and increasing and reducing the output of the heating unit in stages to reduce an amount of the water.

15. The method as set forth in claim 14, wherein the food includes dried fruit.

16. The method as set forth in claim 14, wherein the first reduced output of the heating unit is 50~70% of the initial output.

17. The method as set forth in claim 14, wherein the heating unit is a high frequency generation unit, and a maximum output of the high frequency generation unit is defined as the initial output of the heating unit.

18. The method as set forth in claim 14, wherein the heating unit is a high frequency generation unit, an initial output of the high frequency generation unit is 900 W, and the first reduced output of the high frequency generation unit is 450~630 W.

19. A method of automatic cooking using a cooking apparatus, the cooking apparatus having a cooking cavity that contains food to be cooked and water therein, a heating unit that heats the food and the water, and a gas sensor that detects properties of air inside the cooking cavity, comprising:

obtaining an output of the gas sensor while the food and the water are heated at a preset initial output of the heating unit;

reducing the output of the heating unit to a first reduced output and allowing a heated high temperature water to be absorbed into the food if the output of the gas sensor reaches a preset value; and increasing and reducing the output of the heating unit in stages to reduce an amount of the water.

20. The method as set forth in claim 19, wherein the food includes dried fruit.

21. The method as set forth in claim 19, wherein the output of the heating unit is reduced to the first reduced output if a ratio of a current output of the gas senor to an initial output of the gas sensor reaches a preset value by obtaining the initial output of the gas sensor before the food and the water are heated and obtaining the current output of the gas sensor when the food and the water are heated.

22. The method as set forth in claim 21, wherein the output of the heating unit is reduced to the first reduced output if the current output of the gas sensor is equal to or less than 60% of the initial output of the gas sensor.

23. The method as set forth in claim 19, further including minimizing moisture inside the cooking cavity by circulating the air inside the cooking cavity to obtain the initial output of the gas sensor.

24. The method as set forth in claim 23, further including using a blowing unit to circulate the air inside the cooking cavity and to cool the heating unit when the heating unit is operated.

25. The method as set forth in claim 19, wherein the output of the gas sensor is a voltage level that is inversely proportional to the moisture inside the cooking cavity.

26. The method as set forth in claim 19, further including previously setting a total cooking time according to an amount of food and limiting an end time point of the increasing and reducing of the output of the heating unit to an end time point of the total cooking time.

27. A microwave oven that automatically cooks fruit, comprising:

a cooking cavity that contains fruit to be cooked and water therein;

a magnetron that heats the fruit and the water a gas sensor that detects properties of air inside the cooking cavity; and a control unit operated to obtain an output of the gas sensor while the fruit and the water are heated at a preset initial output, to reduce the output of the magnetron to a first reduced output and allow a heated temperature water to be absorbed into the fruit if the output of the gas sensor reaches a preset value, and then to increase and reduce the output of the magnetron in stages to reduce an amount of the water.

28. The microwave oven as set forth in claim 27, wherein the control unit reduces the output of the magnetron to the first reduced output if a ratio of a current output of the gas senor to an initial output of the gas sensor reaches a preset value by obtaining the initial output of the gas sensor before the fruit and the water are heated and obtaining the current output of the gas sensor when the fruit and the water are heated.

29. The microwave oven as set forth in claim 28, wherein the control unit reduces the output of the magnetron to a first reduced output if the current output of the gas sensor is equal to or less than 60% of the initial output of the gas sensor.

30. The microwave oven as set forth in claim 27, wherein the fruit includes dried fruit.

31. The microwave oven as set forth in claim 27, wherein moisture inside the cooking cavity is minimized by circulating the air inside the cooking cavity to obtain the initial output of the gas sensor.

32. The microwave oven as set forth in claim 31, further comprising a blowing unit that circulates the air inside the cooking cavity, wherein the magnetron is cooled by the blowing unit when the magnetron is operated.

33. The microwave oven as set forth in claim 27, wherein the output of the gas sensor is a voltage level that is inversely proportional to moisture inside the cooking cavity.

34. The microwave oven as set forth in claim 27, wherein a total cooking time is previously set according to an amount of the fruit, and an end time point of an increase and reduction operation of the magnetron's output is limited to an end time point of the total cooking time.

35. The automatic cooking apparatus of claim 1, wherein the heating at the preset initial output is carried out at 900 W for a maximum of 9 minutes.

36. The automatic cooking apparatus of claim 1, wherein, after the output of the heating unit is reduced to a first reduced output for a predetermined period of time, the output of the heating unit is increased to 600 W for two minutes, then is increased to 700 W for one minute for the first steaming stages, and then is reduced to 500 W until a predetermined end time for the second steaming stage.

* * * * *

UNITED STATES PATENT AND TRADEMARK OFFICE

CERTIFICATE OF CORRECTION

PATENT NO. : 6,881,936 B2
DATED : April 19, 2005
INVENTOR(S) : Jong-Chull Shon et al.

It is certified that error appears in the above-identified patent and that said Letters Patent is hereby corrected as shown below:

Title page,
Item [75], Inventors, change city name for all three inventors from "Suwon" to -- Suwon-si --.

Column 7,
Line 29, change "senor" to -- sensor --.

Column 8,
Line 36, change "senor" to -- sensor --.
Line 65, after "water" insert -- ; --.

Column 9,
Line 12, change "senor" to -- sensor --.

Column 10,
Line 14, move line 15 (first word "preset") up to the end of line 14 (last word "the").

Signed and Sealed this

Third Day of January, 2006

JON W. DUDAS
*Director of the United States Patent and Trademark Office*